US006538241B1

(12) United States Patent
Filipsson

(10) Patent No.: US 6,538,241 B1
(45) Date of Patent: Mar. 25, 2003

(54) MICROWAVE OVEN WITH MICROWAVE SEAL

(75) Inventor: Gunnar Karl Filipsson, Linkoping (SE)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/857,591

(22) PCT Filed: Nov. 30, 1999

(86) PCT No.: PCT/EP99/09308

§ 371 (c)(1),
(2), (4) Date: Jun. 7, 2001

(87) PCT Pub. No.: WO00/36878

PCT Pub. Date: Jun. 22, 2000

(30) Foreign Application Priority Data

Dec. 17, 1998 (SE) ..... 9804375

(51) Int. Cl.[7] ..... H05B 6/76
(52) U.S. Cl. ..... 219/742; 174/35 R
(58) Field of Search ..... 219/742, 741, 219/739, 743, 744; 174/35 R; 29/600, 460

(56) References Cited

U.S. PATENT DOCUMENTS 3,666,904 A * 5/1972 Krajewski ..... 219/739
3,668,357 A * 6/1972 Kobayashi ..... 219/741
3,767,884 A * 10/1973 Osepchuk et al. ..... 219/742

FOREIGN PATENT DOCUMENTS

GB 1465106 * 2/1977

* cited by examiner

*Primary Examiner*—Teresa Walberg
*Assistant Examiner*—Quang Van
(74) *Attorney, Agent, or Firm*—Robert O. Rice; Stephen D. Krefman; Thomas J. Roth

(57) ABSTRACT

A microwave oven for heating of foodstuffs including an oven cavity (4) with an opening, a microwave unit for feeding microwaves to the oven cavity, an openable door adapted to close the opening and constituting one of the walls of the cavity, and a microwave seal (6) for reducing the leakage of microwave radiation from the oven cavity when the door is closed. The microwave seal has the form of a groove (12) which surrounds the opening and which is longitudinally divided into a first cavity (7) and a second cavity (8) by a partition (13). When the door is closed, the electric length from the oven cavity to the base of the first cavity is smaller than a quarter of a wavelength, and the electric length from the oven cavity to the base of the second cavity is greater than a quarter of a wavelength, such that two damping peaks are obtained, one on each side of the centre frequency of the microwaves. The position of the damping peaks is determined by projections which are arranged at the top of the partition alternatingly in one and the other direction.

10 Claims, 3 Drawing Sheets

MICROWAVE OVEN WITH MICROWAVE SEAL

FIELD OF THE INVENTION

The present invention relates to a microwave seal for the cavity of a microwave oven for heating of food.

BACKGROUND ART

Microwave ovens are usually provided with a seal round the opening of the oven cavity to prevent microwave radiation from leaking out of the oven. The seal must be efficient since authorities in a plurality of countries have adopted low limit values of how much microwave radiation is allowed to leak out of the oven cavity.

A microwave oven usually has an oven cavity which is accessible through a door which at the same time constitutes one of the walls of the cavity. As a microwave seal, use has previously been made of, for instance, a sealing cavity which as a rule is placed in the door and which surrounds the opening to the oven cavity. The sealing cavity has a depth corresponding to a quarter of a wavelength of the microwaves to function as a short circuit for the microwaves. An alternative microwave seal is disclosed in U.S. Pat. No. 4,471,194 and is based on two sealing cavity spaces being arranged in parallel in order to further decrease the leakage of microwave radiation out of the oven cavity. The cavity spaces are adjusted so that the leakage is minimised at 2.45 GHz.

The microwave source in a microwave oven usually emits microwaves in the frequency range 2.4 GHz to 2.5 GHz in dependence on, among other things, the load in the oven. It is therefore necessary to achieve good damping in all this frequency range. However, the damping is sensitive to the dimensioning of the sealing cavities.

Microwave ovens are generally fitted with a switch-off means which ensures that the microwave source is switched off as the door is opened. However, the door must in reality be opened somewhat before the microwave source is switched off. Also a small degree of opening of the door results in a change of the electromagnetic properties. A problem in prior-art microwave seals thus is that the leakage of microwaves is sensitive even to a small variation of the space between the door and the marginal area round the opening of the oven cavity.

Another problem is that it may be difficult to minimise in a simple way the leakage of microwaves at the corners of the door since the geometry in the corners is different from that at the sides of the door.

One more problem of the prior art sealing solutions is that it may be difficult to adjust the microwave seal to other irregularities adjacent to the opening, such as hinges and catches.

SUMMARY OF THE INVENTION

A main object of the present invention is to provide a microwave oven having a microwave seal, the damping of which is less sensitive to the dimensioning than prior-art microwave seals.

A further object of the present invention is to provide a microwave oven having a microwave seal, the damping of which is less sensitive to the changes in geometry that arise as the door is opened.

One more object of the present invention is to provide a microwave oven having a microwave seal, which can easily be adjusted to different geometries.

A further object of the present invention is to provide a microwave oven having a microwave seal, which can easily be adjusted to different irregularities adjacent to the opening.

These objects are achieved by a device and a method having the features defined in the claims.

For the leakage of microwaves out of a microwave oven to be smaller than the permissible values, sufficient damping of the microwaves in the microwave seal of the oven cavity opening thus is necessary. The starting point of the invention has been that the damping of leaking microwaves in a microwave oven has a maximum at a certain frequency when using a microwave seal having a single cavity according to prior-art technique. The frequency for the maximum depends on the electric length from the oven cavity to the base of the cavity. The microwave seal is conventionally designed so that maximum conforms with the centre frequency of the microwaves.

When using a microwave seal with a single cavity, the desirable damping, however, is achieved in a narrow frequency range only. When opening the door, the electric path from the oven cavity to the sealing cavity changes, and the damping achieves a maximum for another frequency. The change of the maximum of the damping means that the leakage can be too great for certain frequencies at which the microwave source emits microwaves.

A basic idea of the invention is to provide a damping curve that is wide in the frequency plane. This is achieved by using a microwave seal which has a damping of microwaves with maxima at different frequencies, preferably at a frequency slightly above or slightly below the centre frequency round which microwaves are emitted from the microwave source. Thus, the microwave seal is deliberately adjusted so that the damping is not maximised for the centre frequency of the microwaves.

According to one aspect of the present invention, use is made of a microwave seal with two parallel sealing cavities, the electric length of each sealing cavity from the oven cavity being slightly above or slightly below a quarter of a wavelength of the microwaves at the centre frequency. This results in a damping curve as a function of the frequency which has a minimum between two maxima.

In a preferred embodiment, use is made of a microwave seal with two parallel sealing cavities, the electric length from the oven cavity to the base of the sealing cavities being slightly above or slightly below one quarter of a wavelength of the microwaves at the centre frequency. This results in a damping curve as a function of the frequency which has a minimum between two maxima.

By a quarter of a wavelength is meant in the following a quarter of a wavelength of the microwaves at the centre frequency.

The electric length is expressed in the number of wavelengths and is defined for a given frequency. The electric length of, for instance, a waveguide corresponds to the number of wavelengths contained in the waveguide.

The electric length of a cavity can also be changed, for instance, by a material, which has a relative permittivity greater than one, being arranged in the sealing cavity.

The fact that the electric length is a quarter of a wavelength of the microwaves is equivalent to the fact that the natural frequency equals the microwave frequency in the case where the cavity is terminated with a short circuit for the microwaves.

By the damping at the local minimum being made sufficiently great, good damping is obtained over a wide frequency spectrum while at the same time the damping is relatively insensitive to, for instance, the door being slightly opened.

An advantageous choice of the natural frequencies of the sealing cavities is that they are between 50 and 600 MHz, preferably between 150 and 300 MHz, above and respectively below 2.45 GHz, which is the centre frequency of the microwave source.

The microwave seal is preferably placed on the edge portion of the door, the openings of the cavities being directed towards the marginal area round the opening of the oven cavity when the door is closed. Alternatively, the microwave seal is placed round the opening, the openings of the cavities being directed towards the door when closed.

It is particularly advantageous to use a microwave seal which surrounds the opening of the oven cavity and which has the form of two cavities separated by a partition. The partition can then be made separately and then easily be mounted in place, for instance, by welding.

According to one aspect of the invention, the microwave sealing means is formed as a groove which is divided into two cavities by means of a partition. The groove has two essentially opposite side walls. Preferably the partition is provided with damping-controlling projections which are arranged on the partition. The projections are arranged in at least two sets, one set being directed essentially to one side wall and the other set being directed essentially to the other side wall. The two sets of projections affect the cavity length of one cavity each. It is advantageous to employ said partition with projections also in the case where the microwave seal is designed such that the electric length from the oven cavity to the base of the sealing cavity is the same for both sealing cavities.

The partition preferably has the same height as the groove, so that the upper edge of the partition is on a level with the upper edges of the groove.

The projections preferably extend from the upper edge, but alternatively they can extend a small distance down from the upper edge of the partition.

Owing to the projections on the partition being directed opposite ways, the electric lengths of the cavities can be varied independently of each other by varying the length of the projections transversely of the partition.

It is advantageous to design the partition so that the projections are arranged alternatingly directed towards one side wall and towards the other side wall. In this case, only one projection thus extends from each part of the partition. A satisfactory dividing of the cavities is obtained even if less than half the length of the partition is provided with projections.

The partition with projections according to the invention can easily be produced starting from a strip-shaped metal sheet. Then the microwave seal can advantageously be made by a method comprising the steps of forming a groove round the opening of the oven cavity, providing a strip-shaped metal sheet which has two longitudinal edges, making slots from one longitudinal edge to a certain depth therefrom, thereby producing projections, bending the projections, made between the slots, away from the plane of the metal sheet one way and the other in a predetermined pattern, and arranging the metal sheet in the groove, so that the groove in the longitudinal direction is divided into two parallel cavities, the lengths of the projections transversely of the metal sheet being adjusted so that the cavities obtain the desired electric length and preferably lengths which correspond to slightly more or slightly less than a quarter of a wavelength of the length of the microwaves at the centre frequency.

According to a further aspect of the invention, the projections have a transversely directed inner part adjacent to the partition and an outer part fixed, angled preferably downwards, to the inner part.

Two or more juxtaposed projections can be directed the same way, but preferably the projections are arranged alternatingly in different directions.

The sum of the distance between two projections directed the same way and the width of one of the projections in the direction of the partition is preferably smaller than a quarter of a wavelength.

In the case where the projections are alternatingly bent in different directions, the distance between two projections which are bent the same way is advantageously greater than 5 mm and preferably greater than 10 mm. This facilitates the mounting of the partition in the groove by means of welding.

The partition is preferably formed as a whole piece, but can also be slotted from the edge provided with projections down towards the base of the groove.

In a preferred embodiment, the projections are rectangular, but also other shapes of the projections are possible. Alternatively the projections can be formed as triangles or rectangles with rounded corners.

The partition preferably consists of a homogeneous metal sheet, but may also consist of, for instance, a metal network moulded into plastic.

It goes without saying that the above aspects can be combined in the same embodiment.

In the following, detailed embodiments of the invention will be described with reference to the Figures.

DESCRIPTION OF PREFERRED EMBODIMENTS

Figure 1:
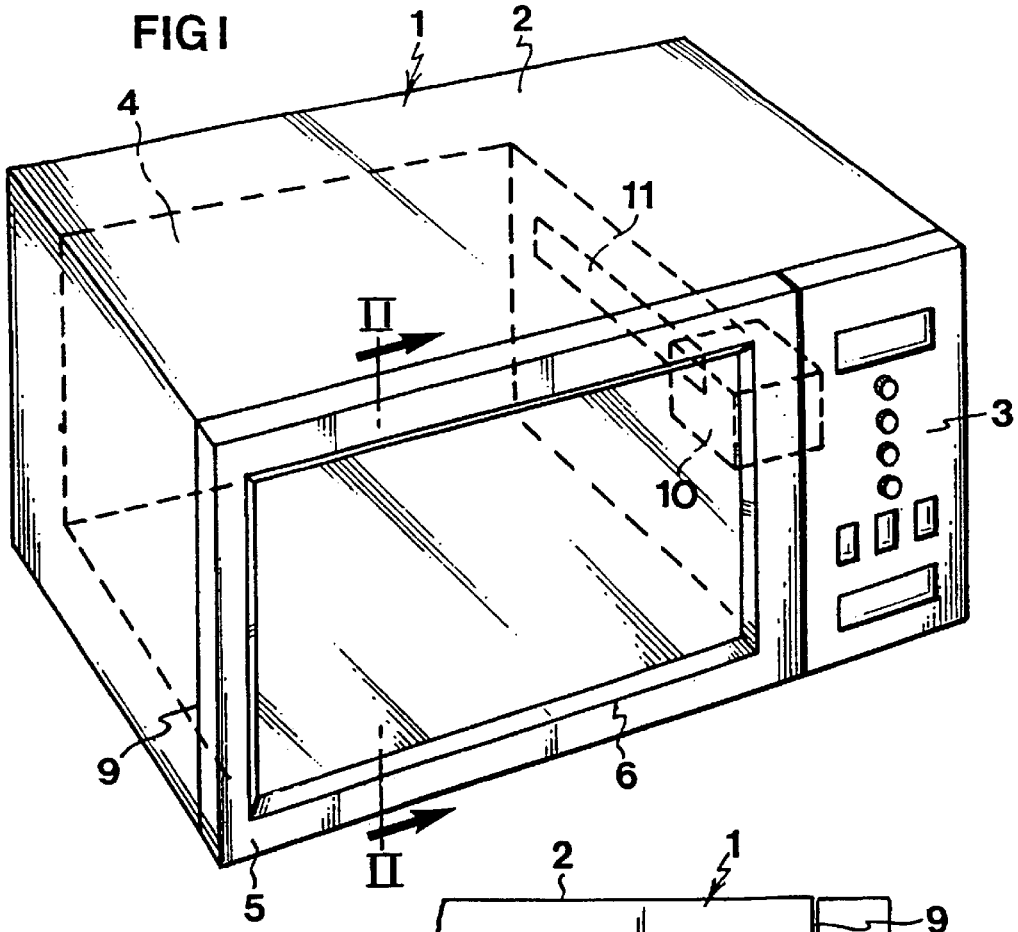
FIG. 1 illustrates a microwave oven according to a preferred embodiment of the invention, which has a microwave seal arranged on the door.

FIG. 1 shows a microwave oven 1 in accordance with an embodiment of the present invention. The microwave oven has a casing 2, a control panel 3 and an oven cavity 4 which is arranged in the casing and in which the food is intended to be placed during cooking. One wall of the oven cavity consists of a door 5 which closes an opening to the oven cavity during cooking. The door is in its marginal portion provided with microwave sealing means 6 which comprise two parallel sealing cavities 7, 8. When the door is closed, the openings of the cavities are directed towards a surface 9 which surrounds the opening of the oven cavity. The microwave oven is also in a conventional manner provided with a microwave source 10 for the generation of microwaves at the frequency 2.45 GHz and microwave feeding means 11 for feeding microwaves to the oven cavity 4.

Figure 2:
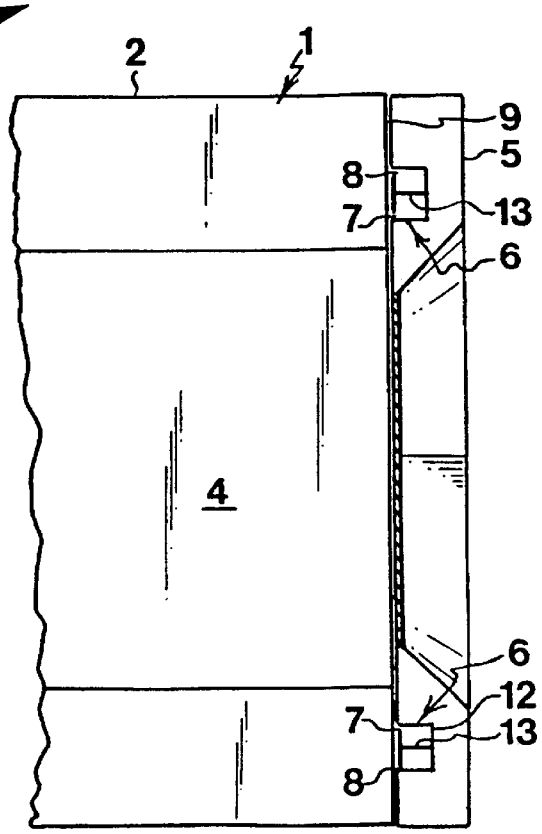
FIG. 2 is a cross-sectional view of the microwave seal along line II—II in FIG. 1.
Figure 5:
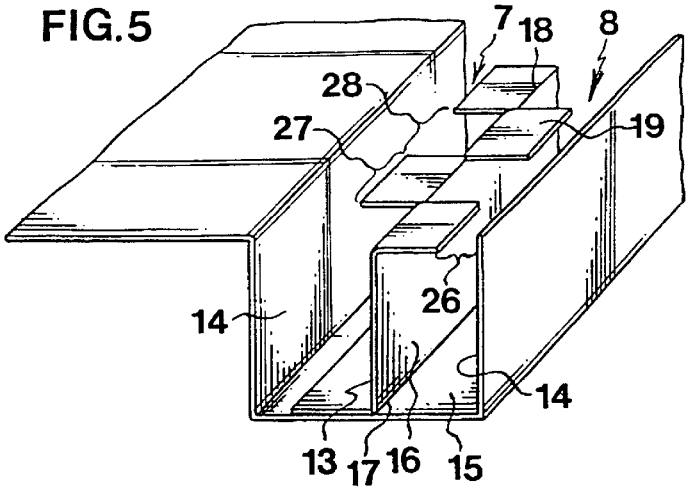
FIG. 5 shows part of an embodiment of a microwave seal according to the present invention.

FIG. 2 is a cross-sectional view of the microwave seal along line II—II in FIG. 1. FIG. 5 is a perspective view in cross-section of part of a metallic microwave seal according to a preferred embodiment of the present invention. The door which closes the oven cavity 4 is in its marginal portion provided with a groove 12, which by means of a homogeneous partition 13 in the longitudinal direction of the groove is divided into two parallel sealing cavities 7, 8. The groove has two essentially parallel side walls 14 and a base 15. The partition 13 dividing the groove 12 has a part 16 which is essentially parallel with the side walls and which at its one longitudinal edge 17 is fixed to the base of the groove and at its other longitudinal edge 18 is provided with rectangular projections 19. The projections are alternatingly directed essentially perpendicular to the side walls 14 away from the partition part 16 which is parallel with the side walls. The partition can be fixed to the base 15 of the groove 12 in some suitable fashion, for instance, by welding or by a screw joint. From each partial length of the partition protrudes only one projection, which makes the partition easy to manufacture from a strip-shaped metal sheet.

The cavities are in the preferred embodiment arranged in such manner that, when the door is closed, the first sealing cavity is resonant at a frequency which is lower than 2450 MHz by between 150 and 300 MHz, and the second cavity is resonant at a frequency which exceeds 2450 MHz by between 150 and 300 MHz. This corresponds to the condition that the electric length from the oven cavity 4 to the base of the first cavity 7 is slightly smaller than a quarter of a wavelength of the microwaves at the centre frequency 2450 MHz, and that the electric length from the over cavity 4 to the base of the second cavity 8 is slightly more than said quarter of a wavelength of the microwaves.

Figure 3:
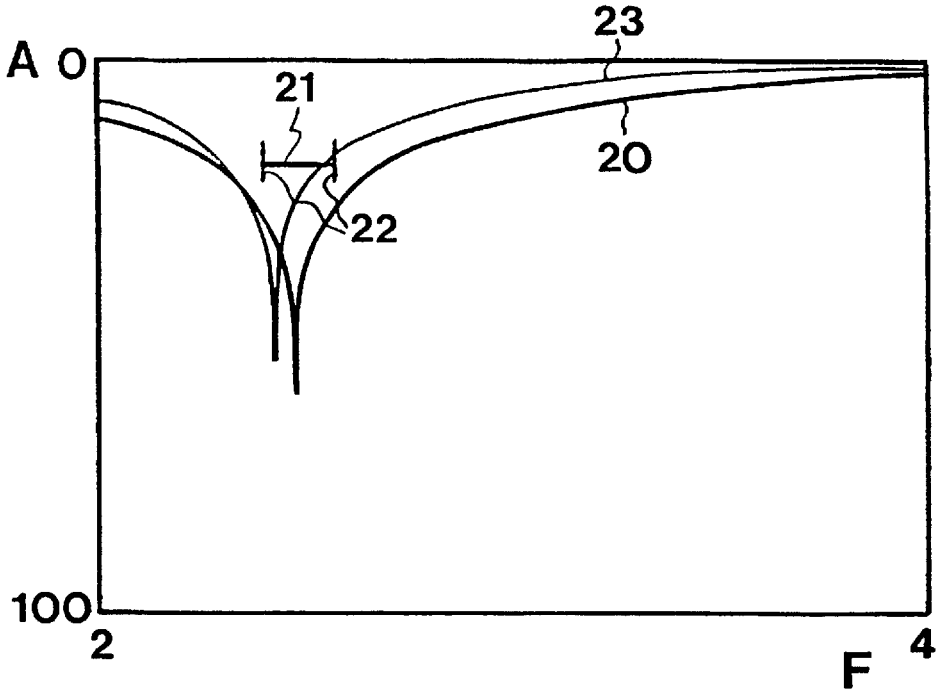
FIG. 3 shows typical curves of the damping as a function of the frequency for a prior-art microwave seal with a single cavity.

FIG. 3 shows theoretical calculations of the damping as a function of the frequency for a microwave seal with a conventional single cavity which, when the door is closed, has an electric length corresponding to a quarter of a wavelength. In FIG. 3, the curve 20 indicates the damping (A) in decibel as a function of the microwave frequency (F) when the door is closed. The damping has a maximum at the frequency 2.45 GHz, which corresponds to the centre frequency of the microwave source. The line 21 in the Figure indicates the desirable damping, and the two vertical lines 22 indicate the frequency range 2.4 GHz to 2.5 GHz, within which microwave radiation is emitted from the microwave source. It is apparent from the Figure that the desirable damping is achieved throughout the frequency range within which microwave radiation can be emitted. In FIG. 3, the curve 23 indicates the damping (A) in decibel as a function of the microwave frequency (F) when the door has been opened by 2 mm at its one edge. The maximum of the damping has been slightly displaced from 2.45 GHz. It is evident from the Figure that the desirable damping is not obtained throughout the frequency range within which microwave radiation is emitted.

Figure 4:
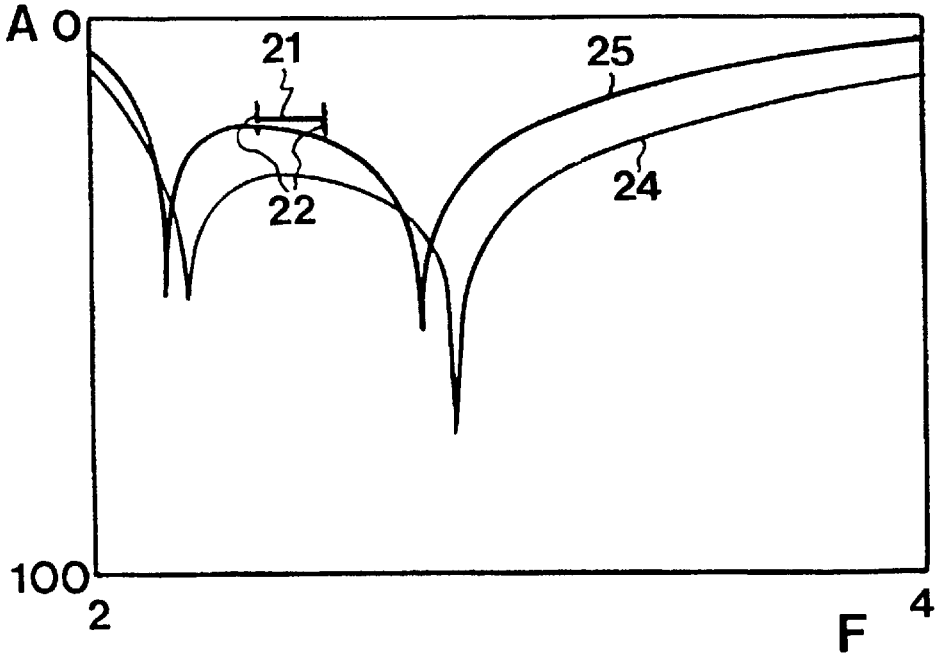
FIG. 4 shows damping curves for an embodiment of a microwave seal according to the present invention.

FIG. 4 shows theoretical calculations of a typical damping as a function of the frequency for a microwave seal with double cavities which, when the door is closed, are resonant at 2.8 GHz and 2.2 GHz, respectively. In FIG. 4, the curve 24 indicates the damping (A) as a function of the microwave frequency (F) when the door is closed. The damping has a maximum at 2.2 GHz and at 2.8 GHz. Also in this case, the line 21 in the Figure illustrates the desirable damping, and the two vertical lines 22 indicate the frequency range 2.4 GHz to 2.5 GHz, within which microwave radiation is emitted from the microwave source. It is apparent from the Figure that the desirable damping is obtained throughout the frequency range within which microwave radiation is emitted. In FIG. 4, the curve 25 indicates the damping (A) as a function of the microwave frequency (F) when the door has been opened by 2 mm at its one edge. The maximum of the damping has been slightly displaced from 2.2 GHz and 2.8 GHz, respectively. It is apparent from the Figure that the desirable damping in this case is obtained throughout the frequency range within which microwave radiation is emitted.

The partition can be manufactured starting from e.g. a strip-shaped metal sheet which has two parallel edges. The parts of the strip-shaped metal sheet which are to constitute projections are formed by slots being cut in the strip-shaped metal sheet from one edge thereof. The slots define the sides of the intended projections. The length of the projections perpendicular to the longitudinal direction of the metal sheet is then adjusted to the geometry of the groove. Subsequently the projections are folded along a line extending in the longitudinal direction of the metal sheet, at right angles to the continuous metal sheet, alternatingly one way and the other.

The natural frequency for a sealing cavity is inversely proportional to $\sqrt{L \cdot C}$, where L is the total inductance seen from the oven cavity to the base of the cavity and C is the total capacitance seen from the oven cavity to the base of the cavity. By varying the distance 26 between the side wall of the groove and a projection, it is possible to affect C, and by varying the total distance between the oven cavity and the base of the cavity, L can be affected. The sum of the width 27 of a projection and the distance 28 between two projections directed the same way is suitably smaller than a quarter of a wavelength, which corresponds to approx. 30 mm, thereby preventing currents from being induced in the partition 13.

If the projections are alternatingly directed different ways, the distance between two projections 19 directed the same way should preferably be more than 10 mm to make it possible to reach, by means of a welding tool, the space between the projections in connection with the welding of the partition to the base of the groove.

Figure 6:
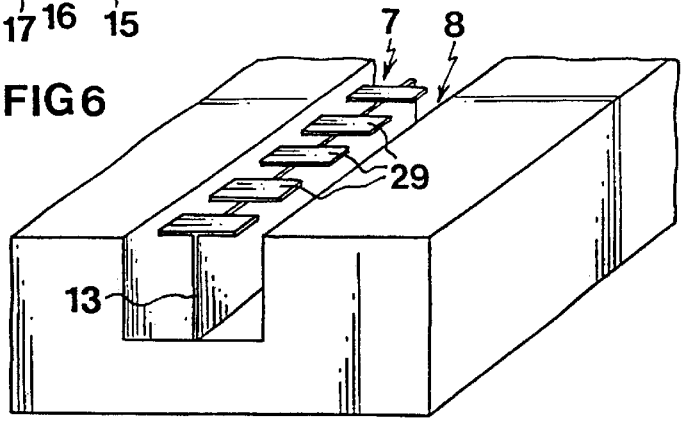
FIG. 6 shows part of another embodiment of a microwave seal according to the present invention.

FIG. 6 is a perspective view in cross-section of part of a microwave seal according to an alternative embodiment of the present invention. In this case, the projections 29 are arranged in pairs and directed opposite ways on the same part of the partition 13. A partition according to this alternative embodiment is slightly more complicated to manufacture since it is necessary to use two metal sheets. Alternatively, it is possible to form projections on each side of a strip-shaped metal sheet and then fold the metal sheet back on itself along a centre line, and then to weld the metal sheet to the base of the cavity.

Figure 7:
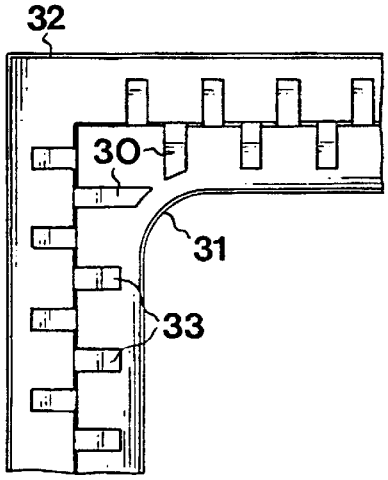
FIG. 7 shows part of a corner portion of a door with a microwave seal according to an embodiment of the present invention.

FIG. 7 shows part of a microwave seal, arranged on the door, according to a preferred embodiment of the present invention. The Figure illustrates a corner portion of the door. For the damping to be satisfactory also in the corner portion of the door, the projections 30 in the corner portion are adjusted so that the cavity lengths are the same also in the corners. In the embodiment shown in FIG. 7, the inner edge 31 of the groove is rounded in contrast to its outer edge 32. By the partition according to the invention having projections on both sides, the cavity resonances can easily be dimensioned also in the corner portions of the door by adjusting the length of the projections. Thus, the length, perpendicular to the partition, of the projections 30 in the corner is greater than the length of the projections 33 along the straight part.

Figure 8A:
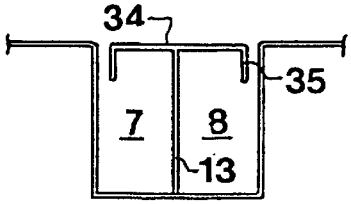
FIGS. 8*a* and 8*b* show different variants of parts of a microwave seal according to embodiments of the present invention.

FIG. 8 illustrates in cross-section different variants of microwave seals according to the present invention. FIG. 8*a* illustrates an embodiment with a partition where the projections have an inner part 34 which is directed essentially perpendicular to the side walls of the groove and an outer part 35 which is directed downwards in parallel with the side wall. An advantage of this embodiment is that the capacitance of the sealing cavity can easily be adjusted by adaptation of the length of the outer part 35 of the projection.

Figure 8B:
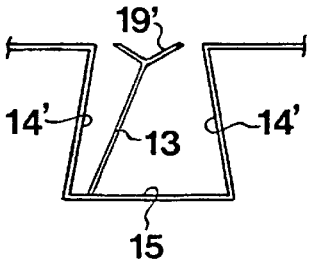

FIG. 8*b* shows an embodiment of a microwave seal where the groove has side walls 14' which are inclined inwards. The distance between the side walls is greater at the base 15 of the groove than at the opening thereof. The partition is not parallel with any one of the two sides walls. The projections 19' are directed essentially opposite ways.

A person skilled in the art will appreciate that there are many possibilities of varying the described embodiments within the scope of the invention.

What is claimed is:

1. A microwave oven (1) for heating of food, comprising:

an oven cavity (4) with an oven cavity opening, a microwave source (10) for feeding microwaves to the oven cavity, said microwaves having a bandwidth around a centre frequency, an openable door (5) adapted to close the oven cavity opening and constituting one of the walls of the oven cavity, a microwave sealing means (6) adapted to reduce the leakage of microwave radiation from the oven cavity when the door is closed, arranged between the oven cavity (4) and the exterior of the oven when the door is closed, such microwave sealing means having the form of a groove (12) which extends along the marginal area around the oven cavity opening and which is, by a partition (13), divided in the longitudinal direction of the groove into a first sealing cavity (7) and a second sealing cavity (8), the openings of the sealing cavities being directed towards the door when the door is closed, characterised in that the electric length of the first sealing cavity from the oven cavity is such that damping of microwave radiation has a maximum at a frequency which is below the centre frequency and the electric length of the second sealing cavity from the oven cavity is such that damping of microwave radiation has a maximum at a frequency which is above the centre frequency.

2. A microwave oven (1) for heating of food, comprising:

an oven cavity (4) with an oven cavity opening, a microwave source (10) for feeding microwaves to the oven cavity, said microwaves having a bandwidth around a centre frequency, an openable door (5) adapted to close the oven cavity opening and constituting one of the walls of the oven cavity, a microwave sealing means (6) adapted to reduce the leakage of microwave radiation from the oven cavity when the door is closed, arranged between the oven cavity (4) and the exterior of the oven when the door is closed, such microwave sealing means (6) having the form of a groove (12), which extends along the edge portion of the door and which is, by a partition (13), divided in the longitudinal direction of the groove into a first sealing cavity (7) and a second sealing cavity (8), the openings of the sealing cavities being directed towards the marginal area around the oven cavity opening when the door is closed, and characterised in that, when the door is closed, the electric length of the first sealing cavity from the oven cavity (4) is such that damping of microwave radiation has a maximum at a frequency which is below the centre frequency and the electric length of the second sealing cavity from the oven cavity (4) is such that damping of microwave radiation has a maximum at a frequency which is above the centre frequency.

3. A microwave oven as claimed in claims 1 or 2, characterised in that the partition (13) is, at its one edge, fixed in the groove and, at its opposite edge, provided with at least two sets of projections (19, 29, 30, 33), which are directed essentially in opposite ways.

4. A microwave oven as claimed in claim 3, characterised in that only one projection protrudes from each part of the partition edge provided with projections.

5. A microwave oven as claimed in claim 4, characterised in that every second projection is directed one way and every second projection is directed essentially the other way.

6. A microwave oven as claimed in claim 5, characterised in that the groove has parallel side walls (14) and a base (15), the projections being arranged perpendicular to the side walls.

7. A microwave oven as claimed in claim 3, characterised in that the sum of the width (27), in the longitudinal direction of the partition, of each projection and the distance (28) between two projections directed the same way is smaller than a quarter of a wavelength of the microwaves.

8. A microwave oven as claimed in claim 7, characterised in that the partition with its projections consists of a continuous metal sheet.

9. A microwave oven as claimed in claims 1 or 2, characterised in that the centre frequency is 2450 MHz, and damping of the microwaves by said sealing means has a maximum at frequencies which respectively are greater and lower than 2450 MHz by between 50 and 600 MHz and preferably by between 150 and 300 MHz.

10. A method of making microwave sealing means for a microwave oven (1) comprising:

an oven cavity (4) with an opening, a microwave source (10) for feeding microwaves to the oven cavity, an openable door (5) adapted to seal the opening and constituting one of the walls of the oven cavity, the method being characterised by the steps of:

forming a groove around the opening of the oven cavity, providing a strip-shaped metal sheet which has two longitudinal edges, making slots from one longitudinal edge to a certain depth therefrom, thereby producing projections, bending the projections, made between slots, away from the plane of the metal sheet one way and the other in a predetermined pattern, and arranging the metal sheet in the groove, so that the groove in the longitudinal direction is divided into two parallel cavities, the length of the projections transversely of the metal sheet being adjusted so that the cavities obtain the desired electric length and preferably electric lengths which correspond to slightly more and slightly less than a quarter of a wavelength at the centre frequency of said microwaves.

* * * * *